US007442890B1

(12) United States Patent
Chen et al.

(10) Patent No.: US 7,442,890 B1
(45) Date of Patent: Oct. 28, 2008

(54) BUTTON DEVICE

(75) Inventors: Yun-Lung Chen, Taipei Hsien (TW); Qing-Hao Wu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/828,361

(22) Filed: Jul. 26, 2007

(30) Foreign Application Priority Data

Apr. 4, 2007 (CN) ..... 2007 2 0200225

(51) Int. Cl.
*H01H 9/16* (2006.01)

(52) U.S. Cl. ..... 200/314; 200/310

(58) Field of Classification Search ..... 200/310–317; 341/22; 345/168–170; 362/29, 30, 293, 362/240, 249, 277, 282
See application file for complete search history.

(56) References Cited

U.S. PATENT DOCUMENTS 3,867,596 A * 2/1975 Schadow ..... 200/523
5,373,132 A * 12/1994 Achermann et al. ..... 200/310
5,534,840 A * 7/1996 Cuingnet ..... 337/1
5,659,162 A * 8/1997 Hart ..... 200/16 A
5,659,297 A * 8/1997 Tatavoosian ..... 340/815.4
6,210,010 B1 * 4/2001 Pontetti et al. ..... 362/24
6,335,500 B1 * 1/2002 Chi et al. ..... 200/341
6,667,451 B1 * 12/2003 Hart ..... 200/314
7,145,091 B1 * 12/2006 Wang ..... 200/302.3
7,202,429 B2 * 4/2007 Bouvier et al. ..... 200/310
7,202,432 B2 4/2007 Nishimura
7,220,931 B2 * 5/2007 Bouvier et al. ..... 200/314
7,235,754 B2 * 6/2007 Rochon et al. ..... 200/406

* cited by examiner

*Primary Examiner*—Michael A Friedhofer
(74) *Attorney, Agent, or Firm*—Frank R. Niranjan

(57) ABSTRACT

A button device for an electronic device includes a transparent active button (10); a switch module (20) located behind the active button, and a holder (30) for holding the switch module therein fixed in the electronic device. The switch module includes a switch base (22), and an actuatable switch head (21) incorporated with the switch base, the switch head includes a luminous component with electric connection to a power supply of the electronic device, the luminous component is configured to be pressed by the active button for urging the switch module to switch on or off the power supply and indicate an on or off state of the power supply.

10 Claims, 2 Drawing Sheets

BUTTON DEVICE

BACKGROUND

1. Technical Field

The present invention relates to a button device, and more particularly to a power button device for a power supply which is for supplying electric power to an electronic device.

2. General Background

A push button is often disposed on a control panel of an electronic device to control a switch behind the control panel.

For example, one conventional button device for an electronic device, includes a panel defining an opening, a button module, a switch, and an indicator Light Emitting Diode (LED). The button module has two opposite ends attached to the panel. A transparent button is suspended at a middle of the button module and aligned with the opening of the panel. The indicator LED is attached behind the button. A triggering member is movable together with the button. The switch remains a pre-determined distance from the panel, and out of alignment with the opening of the panel. The triggering member is laterally inserted between the switch and the panel for triggering the switch when the button is pressed. In use, the button is pressed and urges the triggering member to press a head of the switch to power on or off the electronic device. When the electronic device is powered on or off, the LED becomes luminous or dark consequently. However, in this conventional button device, the structure of the button module and the assembly process are complicated.

Accordingly, a button device having a simplified configuration which overcomes the above-mentioned problems is desired.

SUMMARY

A button device for an electronic device includes a transparent active button; a switch module located behind the active button and a holder for holding the switch module therein fixed in the electronic device. The switch module includes a switch base, and an actuatable switch head incorporated with the switch base, the switch head includes a luminous component with electric connection to a power supply of the electronic device, the luminous component is configured to be pressed by the active button and indicate on or off state of the power supply. When the active button is pressed for turning on or off the power supply, the luminous component is pressed by the active button to urge the switch module to switch on or off the power supply and becomes luminous or dark consequently.

Other objects, advantages, and novel features of the present invention will be drawn from the following detailed description of a preferred embodiment of the present invention with the attached drawings, in which:

DETAILED DESCRIPTION

Figure 1:
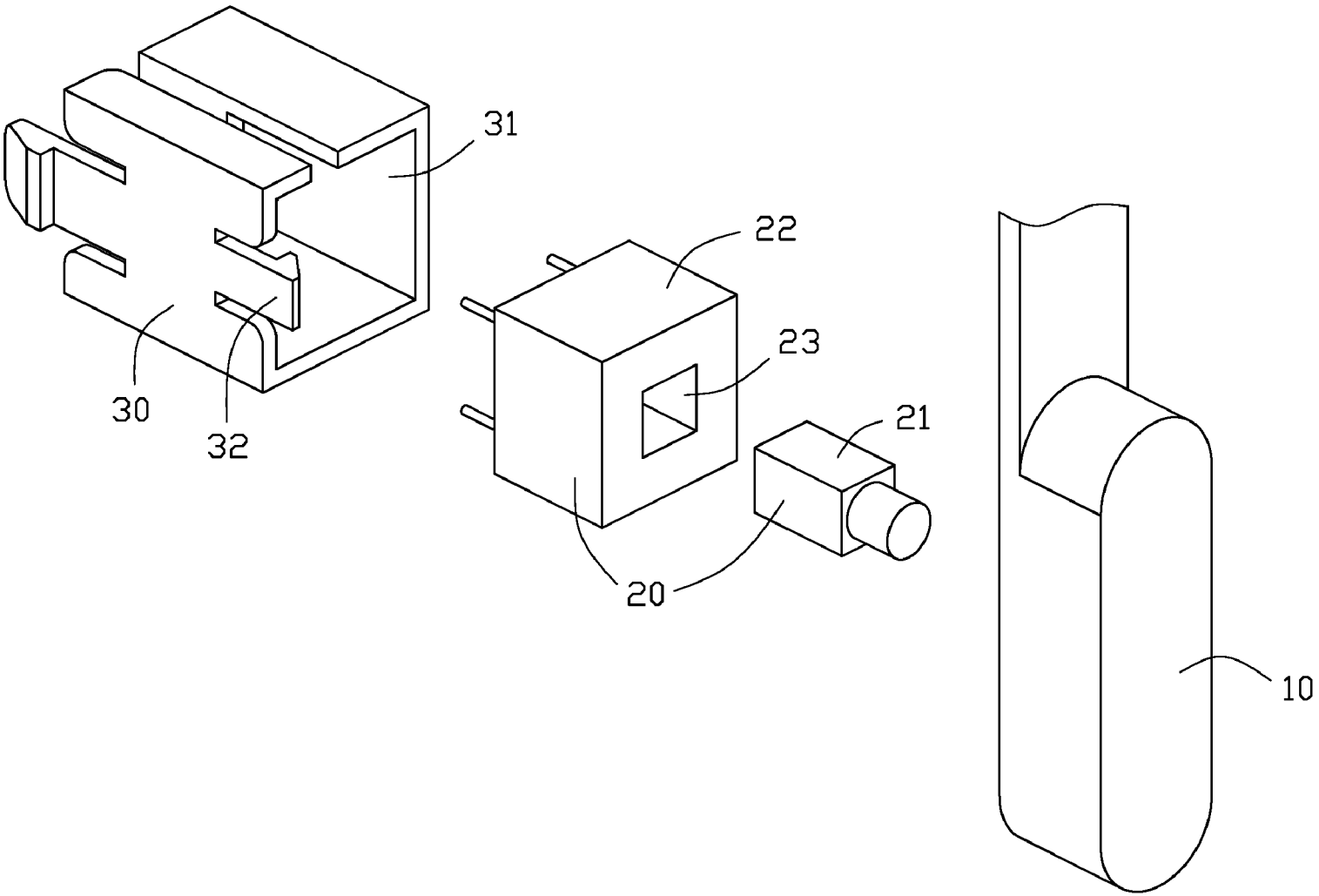
FIG. 1 is an exploded, isometric view of a button device in accordance with a preferred embodiment of the present invention, including an active button, a switch module, and a holder for securing the switch module.

Referring to FIG. 1, a button device for an electronic device in accordance with a preferred embodiment of the present invention includes a transparent active button 10, a switch module 20 with electric connections to a power supply of the electronic device to switch on or off the power supply, and a holder 30 fixed in the electronic device for holding the switch module 20 in the electronic device.

The switch module 20 includes a switch base 22 and an actuatable switch head 21 movably attached to the switch base 22. The switch head 21 includes an LED and a cuboid-shaped rear end incorporated together with the LED. The switch base 22 includes a head housing 23 for mounting the rear end of the switch head 21 therein. The switch module 20 is configured for selectively switching the power supply on or off. The LED of the switch head 21 has positive and negative terminals connecting to the power supply of the electronic device (not shown) for indicating an on or off state of the power supply of the electronic device. When the power supply is switched off by the switch module 20, the LED is switched off accordingly. Thus, the button cap is not illuminated, indicating a power-off state of the power supply. When the power supply is switched on by the switch module 20, the LED is accordingly switched on. The transparent button cap is illuminated by the LED, thus indicating a power-on state of the power supply. In the exemplary embodiment, the LED functions as a switch trigger for triggering switching functions of the switch module 20.

The holder 30 includes a cuboid-shaped switch housing 31 for receiving the switch base 22 of the switch module 20 therein and a resilient hook 32 at one side of the switch housing 31 for catching the switch base 22 of the switch module 20.

Figure 2:
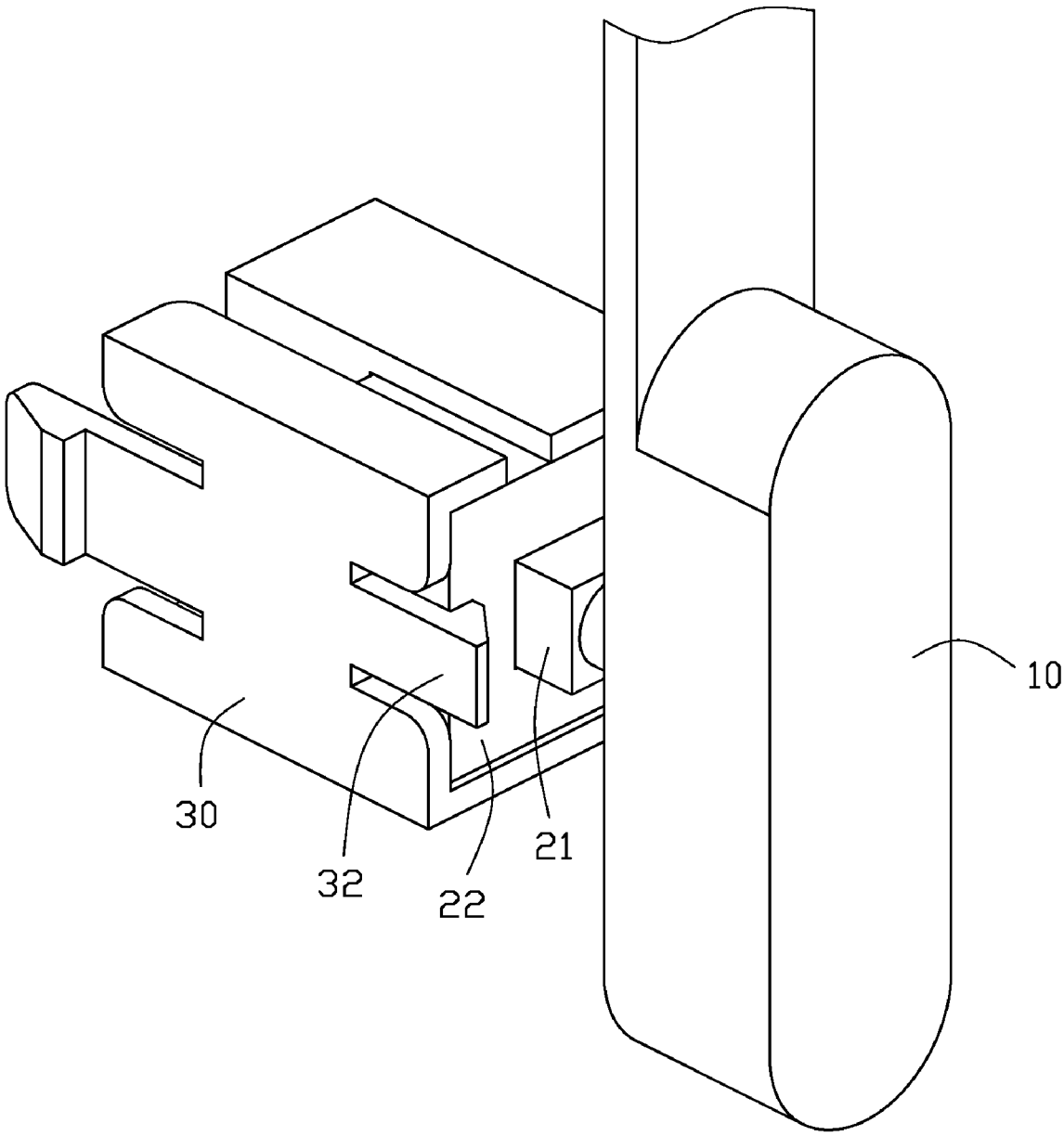
FIG. 2 is an assembled view of the button device of FIG. 1.

Referring also to FIG. 2, in assembly, the rear end of the switch head 21 is movably mounted into the head housing 23 of the switch base 22. Then the assembled switch module 20 is mounted in the switch housing 31 of the holder 30 with the resilient hook 32 catching a front side of the switch base 22 of the switch module 20. The positive and negative terminals of the LED pass through the switch housing 31 of the holder 30 to connect with the power supply (not shown). In this preferred embodiment, after the switch head 21 is pressed inwardly towards the switch base 22 and then released, it urges the switch module 20 to switch on or off the power supply of the electronic device and rebounds back to an original position thereof. The active button 10 is mounted in front of the switch module 20 and capable of moving towards the switch head 21 to activate the switch head 21. A top end of the active button 10 is resiliently fixed to the electronic device (not shown). A lower portion of the active button 10 is free and transparent. Thus the active button 10 is capable of resiliently rebounding back to its original position after a pressing action is performed. A central portion of the transparent portion of the activate button 10 is aligned with the switch head 21 and perpendicular to an axis of the switch module 20 for facilitating actuating the switch module 20 and conducting light from the LED of the switch head 21 evenly.

In use, when the active button 10 is pressed for turning on the power supply of the electronic device, the switch head 21 is pressed inwardly by the active button 10 for urging the switch module 20 to switch on the power supply, and the LED of the switch head 21 is consequently powered on and emits light, which passes through the transparent active button 10 to indicate that the power supply is on; when the active button 10 is pressed again for powering off the power supply, the switch head 21 is actuated again by the active button 10 for urging the switch module 20 to switch off the power supply, and the LED of the switch head 21 is consequently turned off and become dark to indicate that the power supply is powered off.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A button device for a power supply of an electronic device, comprising:

a light-permeable button cap;

a switch module located behind the button cap, comprising a switch, and a switch head disposed under the button cap, the switch head comprising a luminous component with electric connection to the power supply, the switch being configured for switching the power supply between a power-on state in which the luminous component is powered by the power supply, thereby illuminating the button cap and a power-off state in which the power supply and the luminous component are switched off; and a holder for receiving and mounting the switch of the switch module therein;

wherein the button cap is secured to the electronic device; and the button cap comprises a fixed end secured to the electronic device, and a distal free end disposed above the switch head of the switch module.

2. The button device as described in claim 1, wherein the switch comprises a head housing, and the switch head comprises a rear end received in the head housing.

3. The button device as described in claim 2, wherein the luminous component is an LED attached to a front side of the rear end.

4. The button device as described in claim 1, wherein the holder comprises a resilient hook to catch the switch of the switch module.

5. A button device for an electronic device, comprising:

a switch module comprising a switch base fixed in the electronic device and an actuatable luminous component, the luminous component having two terminals connected to a power supply for the electronic device and being powered on or off synchronously with the power supply, the luminous component being movably attached to the switch base; and a transparent button cap having one end secured to the electronic device, and a transparent distal free end portion for urging the luminous component to turn on or off the power supply.

6. The button device as described in claim 5, further comprising a holder fixed in the electronic device configured for receiving and mounting the switch base of the switch module therein.

7. The button device as described in claim 6, wherein the holder comprises a switch housing for mounting the switch base of the switch module therein and a resilient hook protruded at one side of the switch housing for catching the switch base of the switch module.

8. The button device as described in claim 5, wherein the switch module further comprises a switch head attached to the switch base, the switch head comprises a rear end received and mounted in a head housing of the switch base, the luminous component is attached to a front side of the rear end.

9. The button device as described in claim 5, wherein the luminous component is aligned with a central portion of the transparent portion of the transparent button cap.

10. A button device for a power supply of an electronic device, the button device comprising:

a transparent resilient button cap;

a switch module arranged behind the button cap, the switch module comprising a power supply switch for selectively switching the power supply on or off, and a light source device for electrical connection to the power supply, the light source device being arranged between the button cap and the power supply switch, and movable relative to the power supply switch for triggering switching function of the power supply switch; and a holder for securing the switch module to the electronic device wherein the button cap comprises a fixed end secured to the electronic device, and a distal free end disposed above the light source device.

* * * * *